US005824610A

United States Patent [19]

Diehl

[11] Patent Number: 5,824,610

[45] Date of Patent: Oct. 20, 1998

[54] NONWOVEN FABRIC OF NON-CELLULOSE FIBERS HAVING IMPROVED WATER TENSILE PROPERTIES

[75] Inventor: David F. Diehl, Akron, Ohio

[73] Assignee: GenCorp Inc., Fairlawn, Ohio

[21] Appl. No.: 844,894

[22] Filed: Apr. 22, 1997

Related U.S. Application Data

[63] Continuation-in-part of Ser. No. 535,599, Sep. 28, 1995, abandoned.

[51] Int. Cl.[6] ..... D04H 1/58

[52] U.S. Cl. ..... 442/164; 428/902; 442/170; 442/180

[58] Field of Search ..... 442/164, 180, 442/170; 428/902

[56] References Cited

U.S. PATENT DOCUMENTS

| | | | |
|---|---|---|---|
| 3,282,876 | 11/1966 | Williams et al. | 260/29.6 |
| 3,817,899 | 6/1974 | Turck | 260/29.7 |
| 4,226,752 | 10/1980 | Erickson et al. | 260/29.6 |
| 4,529,787 | 7/1985 | Schmidt et al. | 526/317 |
| 4,546,160 | 10/1985 | Brand et al. | 526/320 |
| 4,603,172 | 7/1986 | Albee et al. | 525/143 |
| 4,820,672 | 4/1989 | Tsaur | 524/460 |
| 4,839,413 | 6/1989 | Kiehlbauch et al. | 524/460 |
| 4,845,149 | 7/1989 | Frazee | 524/458 |
| 4,923,919 | 5/1990 | Frasee | 514/460 |
| 4,954,558 | 9/1990 | Tsaur | 525/460 |
| 5,166,259 | 11/1992 | Schmeing et al. | 524/814 |
| 5,191,009 | 3/1993 | Chen et al. | 524/460 |

FOREIGN PATENT DOCUMENTS

| | | |
|---|---|---|
| Hei 3-269032 | 11/1991 | Japan . |
| Hei 4-66959 | 10/1992 | Japan . |
| 1 359 369 | 7/1974 | United Kingdom . |

*Primary Examiner*—James J. Bell
*Attorney, Agent, or Firm*—Robert F. Rywalski; Larry R. Meenan

[57] ABSTRACT

A nonwoven fabric of chemically bonded non-cellulose fibers having improved wet tensile properties. The fabric includes a random arrangement of non-cellulose fibers and an essentially formaldehyde free latex binder. The latex binder contains at least about 6.7 wt % vinyl cyanide monomer to bond the non-cellulose fibers and form a nonwoven fabric having at least a 10% improvement in wet tensile strength over a comparable nonwoven fabric having a latex binder essentially free of formaldehyde and free of vinyl cyanide monomer in the monomeric mixture.

20 Claims, No Drawings

NONWOVEN FABRIC OF NON-CELLULOSE FIBERS HAVING IMPROVED WATER TENSILE PROPERTIES

CROSS-REFERENCE

The present application is a continuation-in-part of my application Ser. No. 08/535,599 filed Sep. 28, 1995 now abandoned, entitled "Nonwoven Fabric Of Non-Cellulose Fibers Having Improved Water Tensile Properties", incorporated herein by reference.

FIELD OF THE INVENTION

The present invention relates to a nonwoven fabric of chemically bonded non-cellulose fibers having improved water tensile properties. More particularly, the present invention relates to a nonwoven fabric of non-cellulose fibers including an essentially formaldehyde free latex binder capable of providing improved water tensile properties.

BACKGROUND OF THE INVENTION

A nonwoven fabric is a web or continuous sheet of fibers laid down mechanically. The fibers may be deposited in a random manner or oriented in one direction. Most widely used fibers include cellulosics, polyamides, polyesters, polypropylene and polyethylene. The spun fibers, which may be drawn, are laid down directly onto a porous belt by carding, airlaying or wet-laying, often with the aid of an electrostatic charge. The sheet is then bonded together with a binder subsequently treated in an oven or a calendar to complete the bonding process.

A number of methods have been developed for applying a binder to randomly-dispersed fibers. Typically, a water based emulsion binder system is used in which a thermoplastic or thermoset synthetic polymer latex is prepared and a loose web of fibers to be treated is immersed therein, saturated or sprayed using special equipment in view of the structural weakness of the web; the thus treated web is dried and cured to effect proper bonding. Alternatively, an aqueous or solvent solution binder system of a thermoplastic or thermoset resin may be used to impregnate the fibrous web.

Still other methods include the application of thermoplastic or thermoset resin powders to the fibers, before or after making a web of the same, and passing the web through hot rolls or a hot press to bind the fibers together. Alternatively, thermoplastic fibers having a softening point below that of the base fibers may be interdispersed in a web of the latter and sufficient heat and pressure applied, such as by the use of heated rolls, to soften the thermoplastic fibers and bind the fiber network together.

Commonly used lattices for non-woven fabrics are those prepared from polymers of butadiene-styrene, butadiene-acrylonitrile, vinyl acetate, acrylic monomers such as methyl acrylate, ethyl acrylate, methyl methacrylate and the like. While the emulsion binder system is the most popular method of forming non-woven fabrics, the homopolymers, copolymers and terpolymers heretofore used therein have suffered from one or more disadvantages. To be useful as a textile material, the synthetic polymer must possess several physical properties. The desired properties include adequate tensile strength over a fairly wide temperature range, a high modulus or stiffness under certain conditions, and good textile qualities such as tenacity, handle and drape.

It will be appreciated that it has been an accepted practice to use self crosslinking or melamine formaldehyde resin posted lattices to give improved water tensiles to a nonwoven non-cellulose product. These systems, however, contain and liberate formaldehyde during the dry/cure cycle. In addition, essentially all commercial self crosslinking and melamine posted lattices require a temperature of at least 280° F. and preferably 300° F. for proper crosslinking. However, it will be appreciated that because the melting point of many non-cellulose fibers is below the temperature required for proper crosslinking, e.g., polypropylene is around 250° F., conventional lattices cannot be used. Accordingly, polypropylene fiber in the nonwoven industry has never enjoyed large success. The problem has been in the specific development of a suitable latex binder to give acceptable tensile properties.

It is an object of the present invention to provide a nonwoven fabric of chemically bonded non-cellulose fibers. Another object of the present invention is to provide a nonwoven fabric including a random arrangement of non-cellulose fibers and an essentially formaldehyde free latex binder capable of developing maximum tensile properties at temperatures less than the melt bonding temperature of the non-cellulose fibers. Yet another object of the present invention is to provide a nonwoven fabric including a random arrangement of non-cellulose fibers and an essentially formaldehyde free latex binder capable of providing improved water tensile properties. It is another object of the present invention to provide a nonwoven fabric of chemically bonded non-cellulose fibers that is simple and economical to manufacture.

SUMMARY OF THE INVENTION

Briefly, according to this invention there is provided a nonwoven fabric including a random arrangement of non-cellulose fibers and an essentially formaldehyde free latex binder. The latex binder includes a polymer latex prepared by emulsion polymerization of a monomeric mixture in the presence of a polymeric surfactant. The monomeric mixture consists of a conjugated diene monomer, a vinyl substituted aromatic monomer and a vinyl cyanide monomer. The conjugated diene monomer may be selected from piperylene, isoprene, 2,3-dimethyl-1,3-butadiene, and 1,3-butadiene. The vinyl substituted aromatic monomer may be selected from α-methyl styrene, p-tertiary butyl styrene, m-vinyl toluene, p-vinyl toluene, 3-ethyl styrene and styrene. The vinyl cyanide monomer may be selected from acrylonitrile, methacrylonitrile, ethacrylonitrile and phenylacrylonitrile.

The polymeric surfactant is about 15–35 wt % on a dry latex basis. The polymeric surfactant contains about 25–27 wt % styrene/acrylic acid/α-methyl styrene copolymer in water neutralized with about 6–7 wt % ammonium hydroxides The essentially formaldehyde free latex binder contains at least about 6.7 wt % vinyl cyanide monomer to bond said non-cellulose fibers and form a nonwoven fabric capable of retaining at least about 78% wet tensile strength measured in the cross direction. Alternatively, the nonwoven fabric of chemically bonded non-cellulose fibers has at least a 10% improvement in wet tensile strength over a comparable, the same type, nonwoven fabric having substantially the same monomeric formulation of essentially formaldehyde free latex binder but free of vinyl cyanide monomer.

Suitable non-cellulose fibers include glass fibers or fibers made from high polymers. The high polymers include polyolefins, polyesters, and acrylics, polyamides and the like. The polyolefin fibers include polypropylene, polyethylene, polybutene and their copolymers. The polyester fibers include any long chain synthetic polymer composed of at least 85% by weight of an ester of a dihydric alcohol and terephthalic acid such as polyethylene terephthalate, and, in addition liquid crystal polyesters, thermotropic polyesters and the like. The acrylic fibers include any fiber forming substance containing a long chain synthetic polymer composed of at least 85% by weight acrylonitrile units —$CH_2CH(CN)$—. It will be appreciated that other types of non-cellulose fibers may also be employed in accordance with the teachings of the present invention. For example, high modulus fibers more commonly known as graphite fibers made from rayon, polyacrylonitrile or petroleum pitch may also be used.

The nonwoven fabric of non-cellulose fibers is formed by providing a random arrangement of non-cellulose fibers. Next, an essentially formaldehyde free latex binder is applied to the fibers. Then the latex binder is heat treated to chemically bond the non-cellulose fibers to form a dimensionally stable nonwoven fabric.

DETAILED DESCRIPTION OF THE PREFERRED EMBODIMENTS

The present invention relates to a nonwoven fabric of chemically bonded non-cellulose fibers. The fabric may be used for soft and drapable fabrics such as diaper cover stock, feminine hygiene cover stock, medical gowns, masks, caps and drapes, and for stiff and resilient fabrics such as apparel interliners, furniture skirting, quilts, water bed baffles and clothing insulation and padding.

The fabric of the present invention is made by forming a mat of randomly arranged non-cellulose fibers which are chemically bonded by an essentially formaldehyde free latex binder. The essentially formaldehyde free latex binder is capable of chemically bonding the non-cellulose fibers and forming a dimensionally stable nonwoven fabric. As well known in the art, the latex binder may be applied to the layer of randomly arranged non-cellulose fibers in a spaced, intermittent pattern of binder sites, or uniformly applied throughout the layer of non-cellulose fibers.

As used herein the term "essentially formaldehyde free" refers to a latex binder which does not liberate more than 0.7 (PPM) parts formaldehyde per million parts of latex binder during the conventional dry/cure cycle of the latex binder as determined by the Nash/HPLC method (high performance liquid chromatography) as well known in the art and the term "chemically bonded" as used herein refers to a bond that is not formed as a result of a heat treatment, for example, as by melt bonding as evidenced by a physical change in the fibers.

The non-cellulose fibers of the fabric may be glass fibers or fibers made from high polymers. The glass fibers are of a type well known in the art and manufactured of molten glass extruded through small orifices and then spun at high speeds. Suitable high polymers include polyolefins, polyesters, and acrylics, polyamides and the like. The polyolefin fibers include polypropylene, polyethylene, polybutene and their copolymers. The polyester fibers include any long chain synthetic polymer composed of at least 85% by weight of an ester of a dihydric alcohol and terephthalic acid such as polyethylene terephthalate, and, in addition liquid crystal polyesters, thermotropic polyesters and the like. The acrylic fibers include any fiber forming substance containing a long chain synthetic polymer composed of at least 85% by weight acrylonitrile units —$CH_2CH(CN)$—. It will be appreciated that other types of non-cellulose fibers may also be employed in accordance with the teachings of the present invention. For example, high modulus fibers more commonly known as graphite fibers made from rayon, polyacrylonitrile or petroleum pitch may also be used.

The non-cellulose fibers may be of most any suitable size and randomly arranged to most any suitable thickness depending upon the desired end use of the nonwoven fabric. The non-cellulose fibers are typically of a length of about 0.25 to 2 inches and typically about 1.2–6 denier. The non-cellulose fibers may be laid in an overlapping, intersecting random arrangement to a thickness of about 0.25 inches or less to form a mat of non-cellulose fibers. The non-cellulose fibers may be arranged by most any convenient known manner such as by wet laying, air-laying or carding.

After the non-cellulose fibers are randomly arranged as desired, a latex binder is applied to the fibers. The latex binder is employed in an effective amount which will result in the resulting fabric having sufficient strength and cohesiveness for the intended end use application. It will be appreciated that the exact amount of the latex binder employed depends, in part, upon factors such as the type of fiber, weight of fibrous layer, nature of latex binder and the like. For example, end uses which require a stronger fabric may utilize more binder. A typical content of latex binder applied on a non-cellulose fiber mat is about 15–40 wt %. It is preferred that the minimum amount of latex binder be applied to obtain the minimum desired required physical properties of the nonwoven fabric such as tensile, hand and the like as well known in the art.

The latex binder utilized in accordance with the present invention may be prepared by well-known conventional emulsion polymerization techniques using one or more ethylenically unsaturated monomers and a polymeric surfactant as herein disclosed and additional conventional additives such as free-radical initiators, optional chain transfer agents, chelating agents and the like can be utilized as set forth in U.S. Pat. No. 5,166,259 to Schmeing and White.

Suitable ethylenically unsaturated monomers in the emulsion polymerization reaction include conjugated diene monomers, vinyl substituted aromatic monomers and vinyl cyanide monomers.

The conjugated diene monomers generally contain 4 to 10 carbon atoms, and preferably 4 to 6 carbon atoms. Examples of specific diene monomers include piperylene, isoprene, 2,3-dimethyl-1,3-butadiene, and the like, and preferably 1,3-butadiene. The amount of conjugated diene monomers utilized is from about 50–70 wt %, preferably from about 55–65 wt %, and most preferably about 60 wt %. The vinyl substituted aromatic monomers generally contain 8 to 12 total carbon atoms. Examples of specific vinyl substituted aromatic monomers include α-methyl styrene, p-tertiary butyl styrene, m-vinyl toluene, p-vinyl toluene, 3-ethyl styrene, and the like, and preferably styrene. The amount of vinyl substituted aromatic monomers utilized is from about 16–50 wt %, preferably from about 27–50 wt %, and most preferably about 27 wt %. It will be appreciated that when the amount of vinyl substituted aromatic monomers in the present invention is greater than about 50 wt %, the latex becomes brittle, is unacceptable as a binder and has unacceptable dry and wet tensile properties for non-cellulose nonwoven fabrics. Moreover, the more conjugated diene monomers and less vinyl substituted aromatic monomers added, generally softer hand feel properties and lower tensile properties are obtained in the non-cellulose nonwoven fabrics. Similarly, the less conjugated diene monomers and more vinyl substituted aromatic monomers added, generally stiffer hand feel properties and higher tensile properties are obtained in the non-cellulose nonwoven fabrics up to an amount that the latex binder does not form a continuous film such that the tensile properties decrease and the non-cellulose nowoven fabrics are too stiff.

The vinyl cyanide monomers may be methacrylonitrile, ethacrylonitrile, phenylacrylonitrile and the like, and preferably acrylonitrile. The amount of vinyl cyanide monomers utilized is at least about 6.7 wt %, preferably from about 6.7–15 wt %, and most preferably about 6.7–10 wt %.

The polymeric surfactant is an acrylic resin neutralized in solution. In a preferred embodiment the polymeric surfactant is a resin containing about 25–27 wt % styrene/acrylic acid/α-methyl styrene copolymer in water neutralized with a base such as a ammonium hydroxide, potassium hydroxide, calcium hydroxide and the like and having an acid value of about 100–300 and a weight average molecular weight greater than about 7,000. Most preferably, the polymeric surfactant is neutralized with about 6–7 wt % ammonium hydroxide and has an acid value of about 205 and a weight average molecular weight of about 8,500 and an average weight ratio of monomers in parts by weight of about 37:32:31 of α-methyl styrene, styrene and acrylic acid.

The resin is prepared in accordance with the process described in U.S. Pat. No. 4,529,787 to Schmidt et al., incorporated herein by reference, using a minor amount of diethylene glycol monoethyl ether as a solvent. Additional resins useful in accordance with the present invention may be made in accordance with the teachings of U.S. Pat. No. 4,414,370 to Hamielec et al. and U.S. Pat. No. 4,546,160 to Brandt et al., incorporated herein by reference.

The amount of polymeric surfactant added to the reactor is typically about 15–35 wt %, preferably about 26 wt % on a dry latex basis, and most preferably, it is believed, about 30 wt %.

The free-radical initiators utilized to polymerize the various above latex binder forming monomers include sodium persulfate, ammonium persulfate, potassium persulfate and the like. Other free radical initiators can be used which decompose or become active at the temperature utilized during polymerization such as various peroxides, e.g., cumene hydroperoxide, dibenzoyl peroxide, diacetyl peroxide, The optional chain transfer agent can generally be any suitable chain transfer agent well known in the art. Optional chain transfer agents include mercaptans such as the alkyl and/or aryl mercaptans having from 8 to about 18 carbon atoms and preferably from about 12 to about 14 carbon atoms. The tertiary alkyl mercaptans having from 12 to 14 carbon atoms are highly preferred. Examples of suitable mercaptans include n-octyl mercaptan, n-dodecyl mercaptan, t-octyl mercaptan, t-dodecyl mercaptan, tridecyl mercaptan, tetradecyl mercaptan, hexadecyl mercaptan, and the like as well as mixtures thereof. The amount of the chain transfer agent is generally from about 0.2 to about 2.5 parts per hundred parts monomer, preferably 0.4 to about 0.9 parts per hundred parts monomer, more preferably about 0.7 parts per hundred parts monomer. In a preferred embodiment, the chain transfer agent is a dodecyl mercaptan chain transfer agent such as Sulfole 120 commercially available from Phillips 66 Co.

Chelating agents may also be used during polymerization to tie up various metal impurities as well as to achieve a uniform polymerization. The amount of such chelating agents is generally small, such as from about 0.02 to about 0.08, and preferably about 0.05 parts chelating agent per hundred parts total monomer. Examples of suitable chelating agents include ethylene diamine tetraacetic acid, nitrilotriacetic acid, citric acid and their ammonium, potassium and sodium salts. Preferred chelating agents include those chelating agents commercially available under the name Hamp-ene from Hampshire Chemical.

In a preferred embodiment, the polymerization of the ethylenically unsaturated monomers and polymeric surfactant occurs sequentially. The following examples are illustrative of the sequential addition of the ethylenically unsaturated monomers and polymeric surfactant to form the latex binder.

EXAMPLES 1 AND 2

Two separate lattices were prepared in accordance with the present invention. Each latex was prepared by adding a charge of deionized water, polymeric surfactant and Hamp-ene to a reactor having a volume of about 20 gallons and having a capacity to hold about 140 lb. of latex. After addition of the polymeric surfactant the reactor was then evacuated with a vacuum (about 20 inches of mercury), purged with nitrogen and heated to a desired temperature. Ammonium persulfate was then added to the reactor as about a 10% solution in deionized water.

A charge comprising styrene, butadiene, acrylonitrile and dodecyl mercaptan was then charged to the reactor sequentially in equal batches. Provided in Table 1 are the weight percent amount of styrene, butadiene, acrylonitrile and dodecyl mercaptan which was added to the reactor for the lattices identified as Examples 1 and 2.

TABLE 1

| Charge | Example 1 Weight percent | Example 2 Weight percent |
|---|---|---|
| styrene | 26.9 | 33.6 |
| butadiene | 59.0 | 59.0 |
| acrylonitrile | 13.4 | 6.7 |
| dodecyl mercaptan | 0.7 | 0.7 |

The first batch for each latex was charged to the reactor approximately 5 minutes after the ammonium persulfate was added. Additional batches were then charged to the reactor at staged intervals of about 15 or 20 minutes. The batches may be added over most any suitable number of staged intervals depending upon the amount of latex binder to be polymerized. For example, the batches may be added in equal increments from 6 stages up to 12 or more stages. After the last batch was added to the reactor the reaction was monitored until the solid level of the latex in the reactor indicated an acceptable conversion level. In instances where the rate of reaction during the hold was undesirably slow an additional amount of ammonium persulfate was charged.

After the desired conversion level was reached, each latex was placed in a 60 gallon vessel and steam and vacuum stripped. This procedure included the addition of a defoamer such as Drew L198. The preservative Kathon LX was also added along with the anti-oxidant Bostex 362-C supplied by Akron Dispersion Inc. as well known in the art. Bostex 362-C is an aqueous mixture of ditridecyl thiodipropionate, 4-methyl phenol and reaction product of dicyclopentadiene and isobutylene, sodium dodecylbenzene sulfonate.

Representative physical properties of the preferred styrene-butadiene-acrylonitrile lattices binders are shown in Table 2.

TABLE 2

| PROPERTY | Example 1 | Example 2 |
|---|---|---|
| Solids, % by weight | 45.5 | 47.3 |
| Wet weight/gallon, lbs. | 8.48 | 8.47 |
| Brookfield viscosity, cps | 36 | 48 |
| pH | 7.5 | 7.5 |
| Surface Tension, dynes/cm | 41.3 | 42.6 |
| Glass transition temperature, °C. measured (DSC[1]) | −20 | −24 |
| Particle charge | anionic | anionic |
| Particle size, Å | 619 | 727 |

[1]Differential Scanning Calorimetry

EXAMPLE 3

For comparison purposes, a latex binder was prepared using the same procedures and ingredients of Examples 1 and 2 except that the acrylonitrile monomer was omitted from the reactor charge for polymerization to determine the effect of the acrylonitrile monomer. The weight percent amount of styrene, butadiene and dodecyl mercaptan which was added to the reactor for the latex identified as Example 3 is provided below in Table 3.

TABLE 3

| Charge | Example 3 Weight percent |
|---|---|
| styrene | 40.3 |
| butadiene | 59.0 |
| dodecyl mercaptan | 0.7 |

The physical properties of the latex of Example 3 are provided in Table 4.

TABLE 4

| PROPERTY | Example 3 |
|---|---|
| Solids, % by weight | 45.9 |
| Wet weight/gallon, lbs. | 8.46 |
| Brookfield viscosity, cps | 37 |
| pH | 7.5 |
| Surface Tension, dynes/cm | 42.7 |
| Glass transition temperature, °C. measured (DSC[1]) | −26 |
| Particle charge | anionic |
| Particle size, Å | 507 |

[1]Differential Scanning Calorimetry

The resulting latex binders of Examples 1–3 were then applied to separate samples of a nonwoven non-cellulose fiber of a type as previously described using polyester. It will be appreciated that most any suitable method well known in the art such as saturation, immersion or spraying may also be used. Reference is made to the nonwoven fabric industry literature generally for detailed descriptions on the various apparatus and processing structures and conditions for applying a latex binder to fibers to form a fabric.

After applying the latex binders to the nonwoven non-cellulose fiber the latex binders were air dried and then heat treated to bond the non-cellulose fibers and form a dimensionally stable nonwoven fabric. It will be appreciated that the latex binders may also be dried by passing them over the surface of a plurality of steam heated cans or through a heating tunnel or oven which may use circulating hot air or infrared lamps to dry the latex binders. The drying time will be a function of a number of factors such as the heat capacity of the non-cellulose fibers, the type of heating, the oven temperature, air velocities (if circulating air is used), and the rate of passage of the non-cellulose fibers through the oven or heating tunnel. For example, the latex binders may be heat treated by heating and drying the fibers at a temperature of between about 220°–250° F. (fahrenheit) for approximately 60 seconds.

The fabrics in accordance with the present invention exhibited improved water tensile performance properties as shown in Table 5. All of the reported performance properties were determined after conditioning the fabrics in accordance with the present invention for about 24 hours at TAPPI (Technical Association of the Pulp and Paper Industry) Standard Conditions of approximately 72° F. and about 50% relative humidity. The tensile values, both dry and wet, were determined in accordance with ASTM D 1117-80 entitled "Standard Methods of Testing Nonwoven Fabrics" published in the 1980 Annual Book of ASTM Standards. Following the ASTM standard test method, dry tensile measurements were determined by using 1 inch wide and 4 inch long strips of fabric pulled at a rate of 5 inches per minute at an initial jaw separation of 3 inches on an Instron. The wet tensile measurements were determined in substantially the same manner as the dry tensile measurements except the fabric strip was soaked in water solution for about 30 seconds prior to testing on the Instron. The Hand Values are a quantitative measure of the fabric as well known in the textile industry. The Hand Values reported are an average value of the readings determined on a Thwing Albert Handle-O-Meter by using a 5 inch square piece of the fabric. The fabrics were tested on the Handle-O-Meter in the cross machine direction and machine direction and then averaged. The amount of latex binder was calculated as follows. The weight of the fiber (F) was obtained before applying the latex binder (L). After applying the latex binder (L), the fiber was allowed to air dry and the final weight of the fabric was obtained (F+L). The latex binder content reported below was then determined in accordance with the equation L/(F+L)×100. The basis weight of each of the neat fiber of a particular fiber (Table 5) was maintained constant. Sample squares of neat fiber 10 inches by 10 inches were cut and sorted into weight ranges having only a 0.1 gram variance per 100 square inches within a particular Table.

TABLE 5

| EXAMPLE | 1 | 2 | 3 |
|---|---|---|---|
| Air Dry | 1 min. @ | 1 min. @ | 1 min. @ |
| Heat treat | 250 F. | 250 F. | 250 F. |
| Amount of Latex Binder | 42.6 wt % | 39.4 wt % | 40.3 wt % |
| Fiber | Polyester | Polyester | Polyester |
| Denier | 1.2 | 1.2 | 1.2 |
| fiber length | 1.5 in. | 1.5 in. | 1.5 in. |
| Hand Value (grams) | 42.3 | 33.5 | 35.0 |
| Cross-Direction Dry Test | | | |
| tensile (grams) | 605.8 | 555.0 | 532.5 |
| % elongation to break | 45.8 | 41.8 | 51.4 |
| Cross-Direction Wet Test- | water | water | water |
| tensile (grams) | 523.4 | 431.6 | 389.1 |
| % elongation to break | 42.3 | 42.5 | 42.4 |
| Cross-Direction Wet Test- | perchloro-ethylene | perchloro-ethylene | perchloro-ethylene |
| tensiles (grams) | 38.9 | 25.7 | 24.2 |
| % elongation to break | 9.9 | 11.2 | 17.1 |

Table 5 illustrates the improved performance of a nonwoven, non-cellulose fabric having applied thereto a latex binder as previously described. As illustrated in Table 5, improved water tensile properties were obtained in accordance with the present invention for a polyester fiber. It is believed that similar comparisons may be obtained on other fibers such as acrylic fibers, polypropylene fibers, polyethylene fiberglass fibers, polyamide fibers and the like.

Surprisingly, the nonwoven, non-cellulose fabric in accordance with the present invention exhibited improved water tensile properties without requiring a melamine formaldehyde resin as an additive in the latex binder to increase tensile properties. It will be appreciated that although the use of acrylonitrile is typically used in a latex binder to improve the solvent resistance of the latex, e.g., perchloroethylene resistance, the addition of acrylonitrile monomer was found to have an insignificant affect on solvent tensiles but a surprising affect on water tensiles. Accordingly, an acrylonitrile monomer containing latex binder in accordance with the present invention imparts improved water resistance properties to a nonwoven, non-cellulose fabric. As previously explained, an additional advantage of the present invention is that melamine formaldehyde resins are not required and therefore the accompanying disadvantages are not present, e.g., difficult to mix with a latex binder, require a fairly high temperature to cure, and contribute formaldehyde to the work place and to the end use product.

Having described presently preferred embodiments of the invention, it is to be understood that it may be otherwise embodied within the scope of the appended claims.

What is claimed is:

1. A nonwoven fabric of chemically bonded non-cellulose fibers having improved wet tensile properties comprising:

a random arrangement of non-cellulose fibers; and an essentially formaldehyde free latex binder to bond said non-cellulose fibers, said latex binder prepared by emulsion polymerization of a monomeric mixture in the presence of about 15–35 wt % polymeric surfactant, the monomeric mixture including about 50–70 wt % conjugated diene monomer, about 16–50 wt % vinyl substituted aromatic monomer and at least about 6.7 wt % vinyl cyanide monomer, the nonwoven fabric having at least a 10% improvement in wet tensile strength over a comparable nonwoven fabric having a latex binder essentially free of formaldehyde and free of vinyl cyanide monomer in the monomeric mixture.

2. The nonwoven fabric of claim 1 wherein said essentially formaldehyde free latex binder is a latex binder which does not liberate more than 0.7 (PPM) parts formaldehyde per million parts of latex binder during the conventional dry/cure cycle of said latex binder as determined by the Nash/HPLC method.

3. The nonwoven fabric of claim 2 wherein said latex binder is prepared by emulsion polymerization of a monomeric mixture including conjugated diene monomer, vinyl substituted aromatic monomer and vinyl cyanide monomer in the presence of a polymeric surfactant.

4. The nonwoven fabric of claim 3 wherein said conjugated diene monomer is selected from the group consisting of piperylene, isoprene, 2,3-dimethyl-1,3-butadiene, and 1,3-butadiene.

5. The nonwoven fabric of claim 4 wherein said vinyl substituted aromatic monomer is selected from the group consisting of α-methyl styrene, p-tertiary butyl styrene, m-vinyl toluene, p-vinyl toluene, 3-ethyl styrene and styrene.

6. The nonwoven fabric of claim 5 wherein said vinyl cyanide monomer is selected from the group consisting of methacrylonitrile, ethacrylonitrile, phenylacrylonitrile and acrylonitrile.

7. The nonwoven fabric of claim 3 wherein said polymeric surfactant is a resin containing about 25–27 wt % styrene/acrylic acid/α-methyl styrene copolymer in water neutralized with about 6–7 wt % ammonium hydroxide.

8. The nonwoven fabric of claim 1 wherein percent elongation to break cross direction wet test is 92% or more of the percent elongation to break of the cross direction dry test.

9. The nonwoven fabric of claim 3 wherein said non-cellulose fibers are selected from the group consisting of glass fibers or fibers made from high polymers.

10. The nonwoven fabric of claim 9 wherein said high polymers are selected from the group consisting of polyolefins, polyesters, acrylics and polyamides.

11. The nonwoven fabric of claim 10 wherein said polyolefins are selected from the group consisting of polypropylene, polyethylene, polybutene and their copolymers.

12. The nonwoven fabric of claim 10 wherein said polyesters include polyethylene terephthalate, liquid crystal polyesters and thermotropic polyesters.

13. The nonwoven fabric of claim 10 wherein said acrylics include any fiber forming substance containing a long chain synthetic polymer composed of at least 85% by weight acrylonitrile units —$CH_2CH(CN)$—.

14. The nonwoven fabric of claim 3 containing about 15–40 wt % latex binder.

15. The nonwoven fabric of claim 3 wherein said emulsion polymerization occurs in the presence of about 15–35 wt % polymeric surfactant.

16. The nonwoven fabric of claim 3 wherein said emulsion polymerization occurs in the presence of about 30 wt % polymeric surfactant.

17. A nonwoven fabric of chemically bonded non-cellulose fibers having improved wet tensile properties comprising:

a random arrangement of non-cellulose fibers; and an essentially formaldehyde free latex binder to bond said non-cellulose fibers, said latex binder prepared by emulsion polymerization of a monomeric mixture including about 50–70 wt % conjugated diene monomer, about 16–50 wt % vinyl substituted aromatic monomer and at least about 6.7 wt % vinyl cyanide monomer in the presence of about 15–35 wt % polymeric surfactant containing about 25–27 wt % styrene/acrylic acid/α-methyl styrene copolymer in water neutralized with about 6–7 wt % ammonium hydroxide, the nonwoven fabric having at least a 10% improvement in wet tensile strength over a comparable nonwoven fabric having a latex binder essentially free of formaldehyde and free of vinyl cyanide monomer in the monomeric mixture.

18. The nonwoven fabric of claim 17 wherein the monomeric mixture includes butadiene, styrene and acrylonitrile.

19. A method of improving the wet tensile strength of a nonwoven fabric of non-cellulose fibers including an essentially formaldehyde free latex binder, the method comprising the steps of:

providing a monomeric mixture including about 50–70 wt % conjugated diene monomer and about 16–50 wt % vinyl substituted aromatic monomer in the presence of about 15–35 wt % polymeric surfactant containing about 25–27 wt % styrene/acrylic acid/α-methyl styrene copolymer in water neutralized with about 6–7 wt % ammonium hydroxide;

adding to the monomeric mixture at least about 6.7 wt % vinyl cyanide monomer; and emulsion polymerizing the monomeric mixture, wherein the nonwoven fabric has at least a 10% improvement in wet tensile strength over a comparable nonwoven fabric having a latex binder essentially free of formaldehyde and free of vinyl cyanide monomer in the monomeric mixture.

20. The method of claim 19 wherein the monomeric mixture includes butadiene, styrene and acrylonitrile.

* * * * *